US012268306B2

(12) United States Patent
Scarlett

(10) Patent No.: US 12,268,306 B2
(45) Date of Patent: Apr. 8, 2025

(54) CUSHION

(71) Applicant: ROLAPAL LIMITED, Auckland (NZ)

(72) Inventor: Roydon Mark Scarlett, Manukau (NZ)

(73) Assignee: ROLAPAL LIMITED, Auckland (NZ)

( * ) Notice: Subject to any disclaimer, the term of this patent is extended or adjusted under 35 U.S.C. 154(b) by 806 days.

(21) Appl. No.: 17/491,644

(22) Filed: Oct. 1, 2021

(65) Prior Publication Data

US 2023/0108756 A1 Apr. 6, 2023

(51) Int. Cl.
*A47C 27/08* (2006.01)

(52) U.S. Cl.
CPC ..... *A47C 27/081* (2013.01)

(58) Field of Classification Search
CPC .. A47C 27/081; A47C 7/021; A61G 7/05769; A61G 5/1045; A61G 5/1048; A47G 9/10; A47G 9/1027; A47G 9/1045; A47G 9/1063
USPC ..... 5/639, 706, 707; 297/219.12, 225, 297/230.13
See application file for complete search history.

(56) References Cited

U.S. PATENT DOCUMENTS 3,676,276 A * 7/1972 Hirshen et al. ..... A63B 9/00 446/221
3,899,797 A * 8/1975 Gunst ..... E04H 15/20 297/452.41
5,056,533 A * 10/1991 Solano ..... A61G 7/1023 5/655
5,718,010 A * 2/1998 Beier ..... A47G 9/10 5/636
6,038,720 A * 3/2000 Matthews ..... A47C 7/383 5/639
6,141,807 A * 11/2000 Tapper ..... A47C 27/086 5/640
6,874,183 B1 * 4/2005 Taylor ..... A47C 20/027 5/652
8,419,128 B1 * 4/2013 Leach ..... B60N 2/2881 5/655
8,863,334 B2 * 10/2014 Gibbons ..... A47C 20/027 5/652
9,021,635 B1 * 5/2015 Leach ..... A47C 20/02 5/632
9,237,812 B1 * 1/2016 Cordell ..... A47C 7/425
9,307,842 B2 * 4/2016 Gibbons ..... A47C 20/021
D775,479 S 1/2017 Oomen
9,693,638 B1 * 7/2017 Leach ..... A47D 15/006
D1,009,516 S * 1/2024 Porter ..... D6/601
2012/0222218 A1 * 9/2012 Davis ..... A47G 9/1072 5/490
2018/0098648 A1 * 4/2018 Berger ..... A47G 9/1072

OTHER PUBLICATIONS

Pang, Kinnon; Patent Examination Report issued in New Zealand; Patent Application No. 760385; dated Oct. 7, 2020; 4 pages.

* cited by examiner

*Primary Examiner* — David R Hare
(74) *Attorney, Agent, or Firm* — EMERSON THOMSON BENNETT; Daniel A. Thomson

(57) ABSTRACT

A cushion is disclosed herein, including an elongate inflatable bag and a jacket that has a plurality of sleeves, wherein the bag is inflated and is releasably engaged with the jacket such that the bag extends through and turns between the sleeves.

14 Claims, 3 Drawing Sheets

CUSHION

FIELD

The present teaching relates to an inflatable cushion. In one aspect of the present teaching, the cushion is adjustable.

BACKGROUND

Air cushions are beneficial for cushioning comfort and pressure care management, particularly for people in wheelchairs. This is because the air is easily displaced from the area of most bodyweight pressure on the cushion to areas of lesser pressure. However, there are a range of problems with at least some such cushions. In this regard it can be difficult to achieve the right level of inflation for a particular user's weight and size. Over inflation can make the seat very hard to sit on or against, with minimal immersion or 'sinking-into' the cushion. Inadequate inflation on the other hand can mean the user ends up pressing against hard support parts of a chair under or behind the cushion. At least most inflatable cushions do not allow for adjustment of the inflation tension, other than by adding or releasing air.

OBJECT

It is an object of one aspect of the present teaching to go at least some way towards providing an adjustable inflatable cushion. While this applies to several aspects, it should be understood that the object of the present teaching per se is not so limited. It is, rather, simply to provide a useful choice. Any object or advantage applicable to any aspects should not be read-in or inferred into any claims expressed more broadly.

Definitions

The term "comprising" if and when used in this document in relation to a combination of features should not be seen as excluding the option of additional unspecified features or steps. In other words, the term should not be interpreted in a limiting way.

SUMMARY

According to one aspect of the present teaching there is provided a cushion, comprising:

an elongate inflatable bag; and a jacket that has a plurality of sleeves;

characterised in that the bag is inflated and is releasably engaged with the jacket such that the bag extends through and turns between the sleeves.

Optionally the sleeves are substantially parallel to one another.

Optionally opposite ends of the sleeves are open.

Optionally the jacket is or is adapted to be, after inflation, scrunched in or stretched out, and held in that state, to adjust the cushioning provided by the bag.

Optionally the bag has no means to enable it to be further inflated or deflated.

Optionally the bag may or may not be inflated before it is engaged with the jacket.

Optionally the jacket has fasteners that are engaged with a support part of a seat to hold the cushion in an adjustably scrunched or stretched state.

Optionally the support comprises part of a seat backrest.

Optionally the support comprises part of a seat base.

Optionally the support forms part of a wheelchair.

Optionally the bag is turned back on itself to have a generally "S" shape, or an at least partially repeating "S" shape (eg 1⅓ or 1⅔ "S" shapes, etc).

According to a further aspect of the present teaching, there is a cushion comprising an elongate inflatable bag and a case, the bag being turned back on itself to have a generally "S" shape, or an at least partially repeating "S" shape, wherein the bag is positioned within the case and has been compressed or stretched out to adjustably set the amount of cushioning provided by the cushion.

According to a further aspect of the present teaching, there is provided a cushion forming part of a seat, comprising an elongate inflatable bag and fasteners, the bag being turned back on itself to have a generally "S" shape, or an at least partially repeating "S" shape, wherein the bag is engaged with a seat support by way of the fasteners and has been compressed or stretched out to adjustably set the amount of cushioning provided by the cushion.

According to a further aspect of the present teaching, there is provided a method of adjusting cushioning for a seat, comprising scrunching or stretching out a cushion according to any one of the preceding claims when it is part of the seat, so the cushion delivers a desired amount of cushioning.

DRAWINGS

The present teachings are described hereinafter with reference to the accompanying drawings.

DETAILED DESCRIPTION

Figure 1:
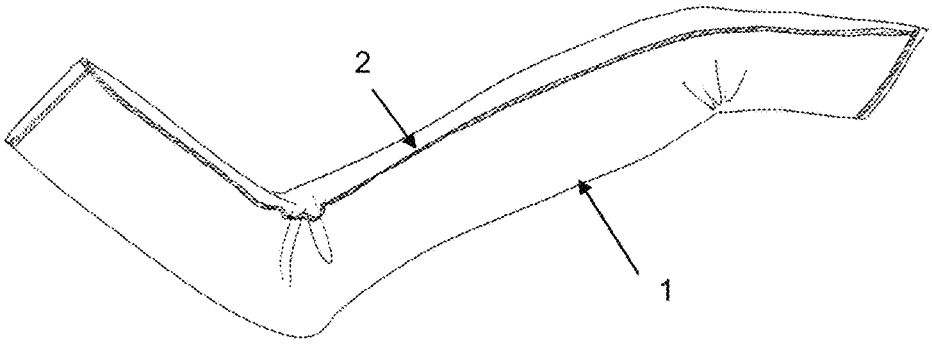
FIG. 1 illustrates an inflatable bag that forms part of a cushion according to one aspect of the present teaching.

Referring to FIG. 1, the inflatable bag 1 is in the form of an airtight flexible elongate tube with sealed seams 2. The bag 1 does not comprise an air valve, and so does not have any means for further inflation or deflation. However in other aspects of the present teaching the bag may incorporate a valve for easy inflation and deflation. The inflatable bag 1 therefore may or may not have the ability to have air or other gases added to or released from it. In either case, the bag 1 should be construed as an inflatable bag. In use the bag 1 may not fully inflated, for example it may be only about half full with air. In some aspects the bag 1 may have sub-compartments.

Figure 2:
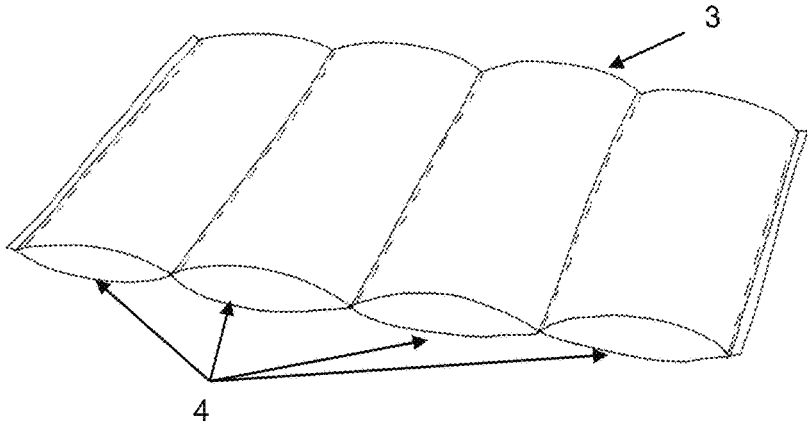
FIG. 2 shows a jacket with four sleeves that also forms part of the cushion.

Referring to FIG. 2, the jacket 3 has four sleeves 4, each open at both ends. However in other aspects of the present teaching may have a different number of sleeves, for example two, three, five or more, and the most outer sleeves may be closed at one end. The sleeves 4 are substantially parallel to one another and adjacent sleeves 4 are connected, for example by stitching or some other means. The sleeves 4 are preferably made of a flexible fabric.

Figure 3:
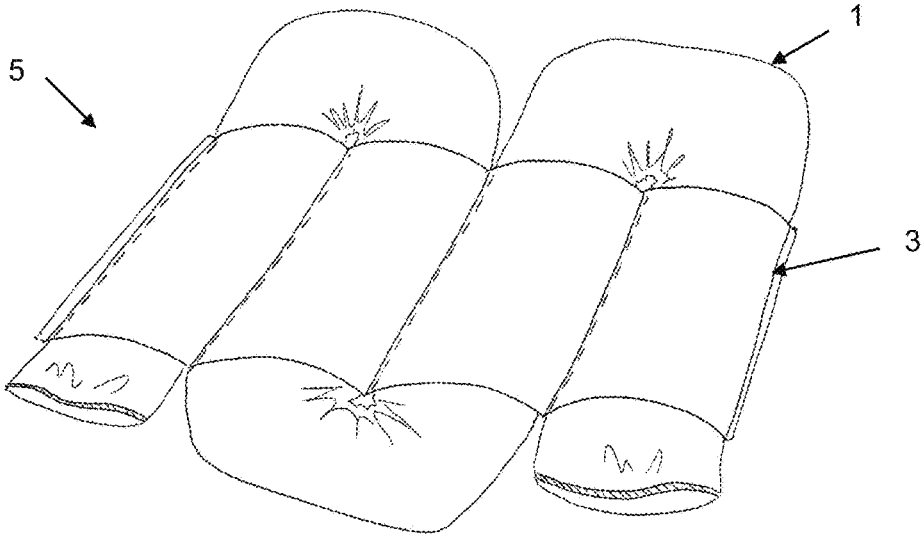
FIG. 3 shows the inflatable bag turned through the sleeves of the jacket to form the cushion.

Referring to FIG. 3, the cushion 5 is formed by threading or turning the inflatable bag 1 in and out of the jacket in a generally serpentine manner. More specifically, the jacket 3 is fed through an outer one of the sleeves 4 and is turned back on itself to pass through the next sleeve. The sleeve is then again turned back on itself and passed through the next sleeve, and so on, until a portion of the bag is within each sleeve as per FIG. 3. The arrangement is such that the bag is left in a repeating, or partially repeating, "S"-shape. Preferably the bag is threaded through the sleeves when it is not inflated, or not fully inflated, so that it is easier to work with. It can be inflated, or more inflated, once engaged with the sleeves as above.

Figure 4:
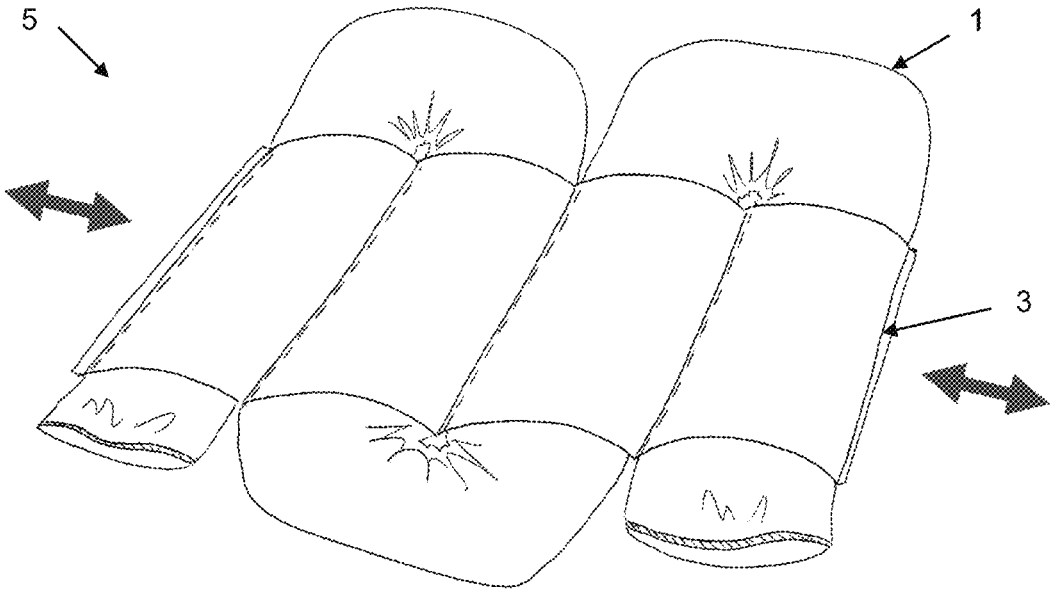
FIG. 4 illustrates how the cushion may be adjusted.

FIG. 4 illustrates how the cushion 5 may be adjusted. In this regard the jacket 3 may be scrunched inwards, and subsequently pulled outwards, so that the effective width of the cushion (i.e. the side to side dimension in the drawing) adjusts. The movement of the jacket inwards (compression) or outwards (stretching) causes the cushion 5 to become firmer or softer respectively. This is because the quantity of air that is in the bag 1 in the area contained by the sleeves 4 changes in response to the compression or stretching. In other words, if the sleeves 4 are pushed together then more air is forced into the jacket 3 area, creating a firmer cushion 5. Likewise, stretching the sleeves 4 out redistributes the air more evenly, creating a relatively softer feeling cushion 5. This allows the cushion 5 to be readily adjusted to a particular user's needs (e.g. based on their weight and/or desired level of immersion) without needing to further inflate or deflate the bag 1.

The jacket 3 can be further adapted to engage with a support of a chair. The support may be anything suitable for adhering a cushion to, for example a chair's seat base or backrest. One particular example is that of a backrest of a wheelchair. In one aspect, the cushion 5 engages with the support by way of fasteners (not shown). The fasteners may be hook and loop fasteners and the support may have a hook and loop receptive panel, although other suitable fastening means are envisioned. Fastening the jacket 3 to a support allows the cushion 5, after compression or stretching, to be held in that state so that the desired level of cushioning is set, until subsequently deliberately adjusted.

Figure 5:
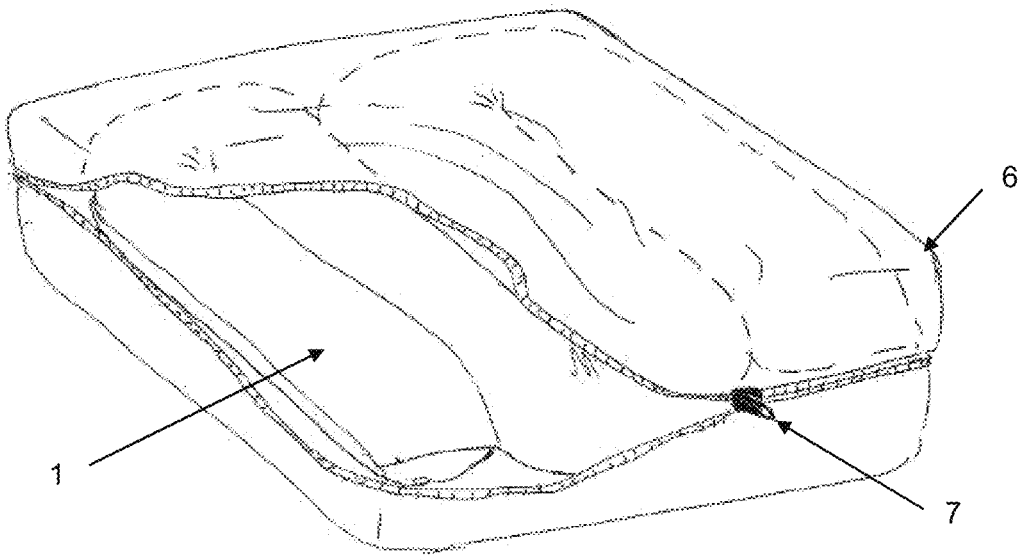
FIG. 5 illustrates the inflatable bag housed inside a case to form a cushion according to another aspect of the present teaching.

In alternative aspects, the inflatable bag 1 may be used without any jacket 3. FIG. 5 illustrates the inflatable bag 1 housed inside a case 6 to form a cushion according to another aspect of the present teaching. In this aspect, the bag 1 is positioned inside the case 6 in a repeating, or partially repeating, "S"-shape, as described above. In some aspects the bag 1 may have fasteners, for example hook and loop type fasteners, to secure it directly to the case. The case is closed and secured by way of a zip 7. However in other aspects other securing means may be used. When secured, the case 6 limits the overall ability of the air inside the bag 1 to redistribute. This allows the bag 1 to retain its shape and provide the desired level of cushioning to the user.

Figure 6:
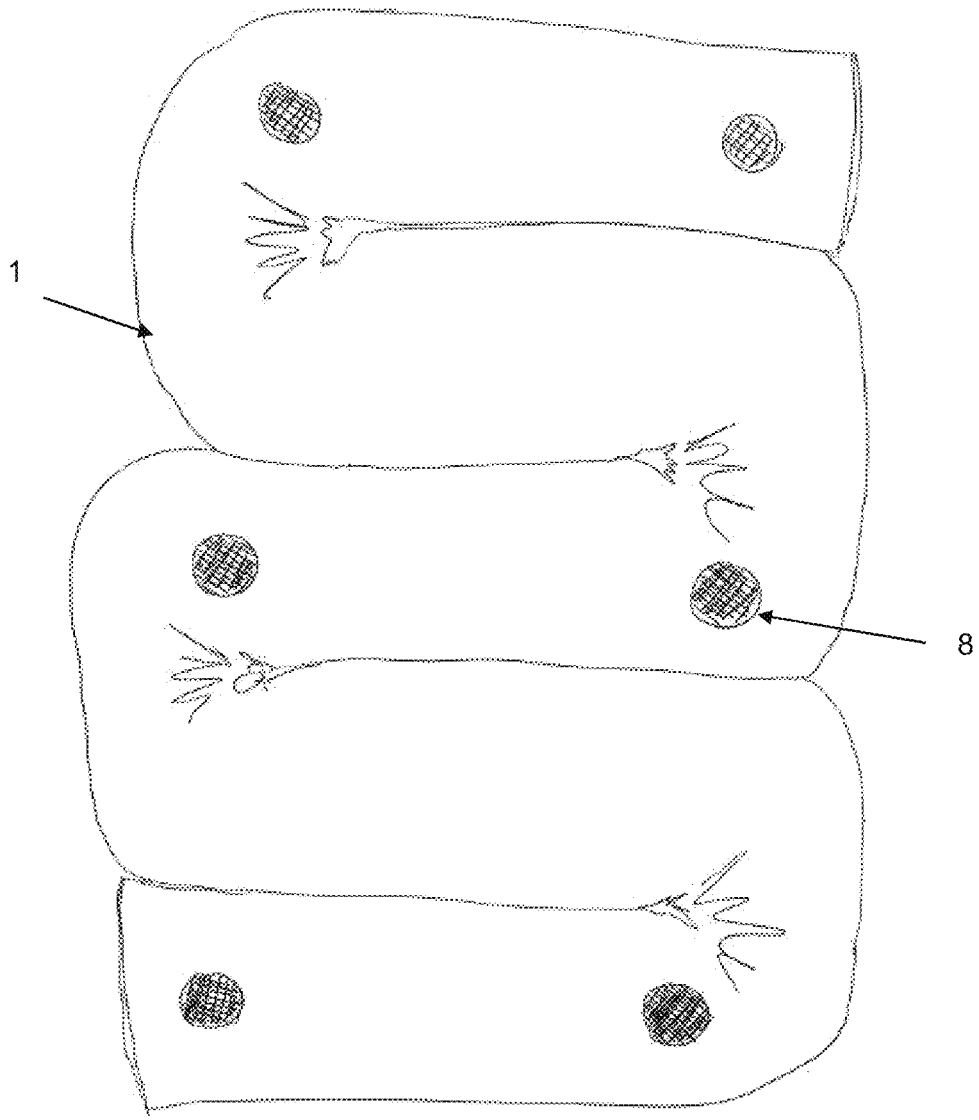
FIG. 6 illustrates the inflatable bag forming a cushion according to yet another aspect of the present teaching.

FIG. 6 illustrates the inflatable bag 1 forming a cushion according to yet another aspect of the present teaching. In this aspect hook and loop type fasteners 8 are attached directly to the inflatable bag 1 for securing it directly to a support (eg seat base or backrest). However in other aspects other fastening means may be used. In use the bag 1 may be turned back on itself in the same repeating or part repeating "S" shape (eg 1⅓ or 1⅔ "S" shapes, etc), and compressed or stretched in a similar way as described above. The compression or stretching of the bag 1 adjusts the cushioning it provides. When compressed or stretched the desired amount, it is set in that way by engaging the fasteners 8 with the support e.g. to a hook and loop receiving surface.

While some aspects of the present teaching have been described by way of example it should be appreciated that modifications and improvements can occur without departing from the scope of the following claims.

In terms of disclosure, this document hereby discloses each item, feature or step mentioned herein in combination with one or more of any of the other item, feature or step disclosed herein, in each case regardless of whether such combination is claimed.

Non-limiting aspects have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

Having thus described the present teachings, it is now claimed:

1. A cushion comprising:

a) an elongate inflatable bag; and b) a jacket that has at least three substantially parallel sleeves, wherein the bag is inflated and is releasably engaged with the jacket such that the bag extends through all of the at least three substantially parallel sleeves, and with the bag further turning back on itself at least twice.

2. A cushion according to claim 1, wherein opposite ends of the sleeves are open.

3. A cushion according to claim 1, wherein the jacket is or is adapted to be, after inflation, scrunched in or stretched out, and held in that state, to adjust the cushioning provided by the bag.

4. A cushion according to claim 1, wherein the bag has no air valve to enable the bag to be further inflated or deflated.

5. A cushion according to claim 1, wherein the bag may or may not be inflated before the bag is engaged with the jacket.

6. A cushion according to claim 1, wherein the cushion further comprises a support part of a seat.

7. A cushion according to claim 6, wherein the support part comprises part of a seat backrest.

8. A cushion according to claim 6, wherein the support part comprises part of a seat base.

9. A cushion according to claim 6, wherein the support part forms part of a wheelchair.

10. A cushion according to claim 1, wherein the bag is turned back on itself to have a generally "S" shape, or an at least partially repeating "S" shape.

11. A cushion according to claim 1 further comprising:

a case, the bag being turned back on itself to have a generally "S" shape, or an at least partially repeating "S" shape, wherein the bag and the jacket are positioned within the case and have been compressed or stretched out to adjustably set the amount of cushioning provided by the cushion.

12. A cushion according to claim 1 further comprising:

fasteners, the bag being turned back on itself to have a generally "S" shape, or an at least partially repeating "S" shape, wherein the bag and the jacket are engaged with a seat support by way of the fasteners and has been compressed or stretched out to adjustably set the amount of cushioning provided by the cushion.

13. A method of adjusting cushioning for a seat, comprising scrunching or stretching out a cushion according to claim 1 when the cushion further comprises a support part of the seat, so the cushion delivers a desired amount of cushioning.

14. The cushion according to claim 1, wherein a longitudinal side of each of the at least three substantially parallel sleeves is butted against and connected directly to a longitudinal side of at least one of the other at least three substantially parallel sleeves.

* * * * *